US011674487B2

(12) United States Patent
Brown et al.

(10) Patent No.: US 11,674,487 B2
(45) Date of Patent: Jun. 13, 2023

(54) CHECK VALVE FOR A FUEL INJECTOR

(71) Applicant: Caterpillar Inc., Peoria, IL (US)

(72) Inventors: Cory Andrew Brown, Peoria, IL (US); Adam L. Stecklein, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/304,127

(22) Filed: Jun. 15, 2021

(65) Prior Publication Data

US 2022/0397084 A1 Dec. 15, 2022

(51) Int. Cl.
*F02M 61/10* (2006.01)
*F02M 61/20* (2006.01)

(52) U.S. Cl.
CPC ..... *F02M 61/10* (2013.01); *F02M 61/20* (2013.01); *F02M 2200/9053* (2013.01)

(58) Field of Classification Search
CPC . F02M 61/10; F02M 61/20; F02M 2200/9053
USPC ..... 123/469, 470, 490; 239/585.5
See application file for complete search history.

(56) References Cited

U.S. PATENT DOCUMENTS 5,580,000 A 12/1996 Kiuchi
7,690,588 B2 4/2010 Gibson et al.
8,602,319 B2 * 12/2013 De Payva ..... F02M 61/12 239/585.4
8,635,992 B2 1/2014 Bernhaupt
9,175,651 B2 11/2015 Kim et al.
9,719,476 B2 8/2017 Rauznitz
9,822,748 B2 * 11/2017 Trocki ..... F02M 61/12
2003/0106533 A1 6/2003 Crofts
2012/0012681 A1 1/2012 Peters
2017/0051714 A1 2/2017 Harcombe et al.

FOREIGN PATENT DOCUMENTS

DE 10123526 A1 11/2002
WO 2015/020940 A1 2/2015

OTHER PUBLICATIONS

Written Opinion and International Search Report for Int'l. Patent Appln. No. PCT/US2022/030615, dated Aug. 30, 2022 (11 pgs).

* cited by examiner

*Primary Examiner* — Hai H Huynh

(57) ABSTRACT

A fuel injector includes a needle valve including a spring-retaining section and a guide section that is adjacent to the spring-retaining section. The spring-retaining section includes an elongated portion and a flange that are together configured to support a spring assembly. The guide section includes a plurality of constricted portions alternatingly arranged with a plurality of expanded portions to define an undulating shape of the guide section. Each of the plurality of expanded portions includes a plurality of indentations to permit fuel to travel therealong to exit an outlet of the fuel injector. The guide section has a length that is substantially equal to a length of the spring-retaining section.

19 Claims, 4 Drawing Sheets

CHECK VALVE FOR A FUEL INJECTOR

TECHNICAL FIELD

The present disclosure relates generally to a needle valve for a fuel injector and, for example, to a needle valve having a guide section that is shaped and sized to attenuate a fuel pressure wave.

BACKGROUND

A fuel injector is a device that is configured to deliver fuel into cylinders of an engine. The engine, in turn, is configured to convert chemical energy stored in the fuel into mechanical work (e.g., to propel and/or power a machine). To control volume of the fuel being dispersed into the cylinders and/or timing of the fuel dispersion, the fuel injector includes a needle valve. The needle valve is an elongated structure that is configured to intermittently open one or more passageways to allow the fuel to exit the fuel injector as desired. However, under certain conditions (e.g., when the fuel injector is utilized to provide multiple injections in quick succession), movement of the needle valve may generate pressure waves in the fuel, which may cause the needle valve to behave erratically. For example, due to variance in the pressure of the fuel, the fuel injector may fail to provide the desired volume of the fuel and/or may fail to correctly time the delivery of the fuel. As a result, one or more components of the engine may become damaged and/or the engine may experience performance issues.

U.S. Pat. No. 9,719,476 discloses a fuel injector device for injecting fuel into a combustion chamber of an internal combustion engine. The fuel injector includes a needle valve and a needle sleeve which are fixed within an inner cavity of a lower chamber. The needle valve is reciprocally moveable within the lower chamber such that when a needle ball is moved out of sealing engagement with an outlet orifice, the needle valve moves upwardly, thereby causing fuel to be delivered from the fuel injector.

The needle valve of the present disclosure solves one or more of the problems set forth above and/or other problems in the art.

SUMMARY

In some implementations, a fuel injector includes a needle valve including a top end surface that is configured to intermittently contact a sealing member of the fuel injector; a bottom end surface that is configured to contact an outlet of the fuel injector when the top end surface is spaced a distance from the sealing member and the needle valve is in a closed position; and an exterior surface that connects the top end surface to the bottom end surface and includes: a spring-retaining section that is adjacent to the top end surface and configured to support a spring that biases the needle valve toward the closed position, a tip section that is adjacent to the bottom end surface, and a guide section that connects the spring-retaining section to the tip section and includes: a first expanded portion including at least one first indentation and having a first diameter, a second expanded portion including at least one second indentation and having a second diameter, and a constricted portion connecting the first expanded portion to the second expanded portion and having a diameter that is less than each of the first diameter and the second diameter.

In some implementations, a fuel injector includes a needle valve including a spring-retaining section including an elongated portion and a flange that are together configured to support a spring assembly, wherein the spring-retaining section has a first length; and a guide section adjacent to the spring-retaining section and including a plurality of constricted portions alternatingly arranged with a plurality of expanded portions to define an undulating shape of the guide section, wherein each of the plurality of expanded portions includes a plurality of indentations to permit fuel to travel therealong to exit an outlet of the fuel injector, and the guide section has a second length that is substantially equal to the first length.

In some implementations, a fuel injector includes a fuel injector body including an interior surface having an opening; and a needle valve slidably arranged within the fuel injector body, the needle valve including a tip section that is configured to seal the opening when the needle valve is in a closed position, a spring-retaining section that is configured to support a spring assembly that biases the needle valve into the closed position, and a guide section extending between the tip section and the spring-retaining section and including at least one indentation that together with the interior surface of the fuel injector body defines at least one fuel passage, wherein a diameter of the guide section is substantially equal to a diameter of the interior surface, and a length of the guide section is substantially equal to each of a length of the spring-retaining section and a length of the tip section.

DETAILED DESCRIPTION

This disclosure relates to a needle valve, which is applicable to any device and/or system involved in controlling flow of a fluid. For example, the device may be a fuel injector. The device may be implemented in a system (e.g., a fuel system, a power system, or another type of system) and/or a machine (e.g., a motor vehicle, a railed vehicle, a watercraft, an aircraft, a generator, or another type of machine).

To simplify the explanation below, the same reference numbers may be used to denote like features. The drawings may not be to scale.

Figure 1:
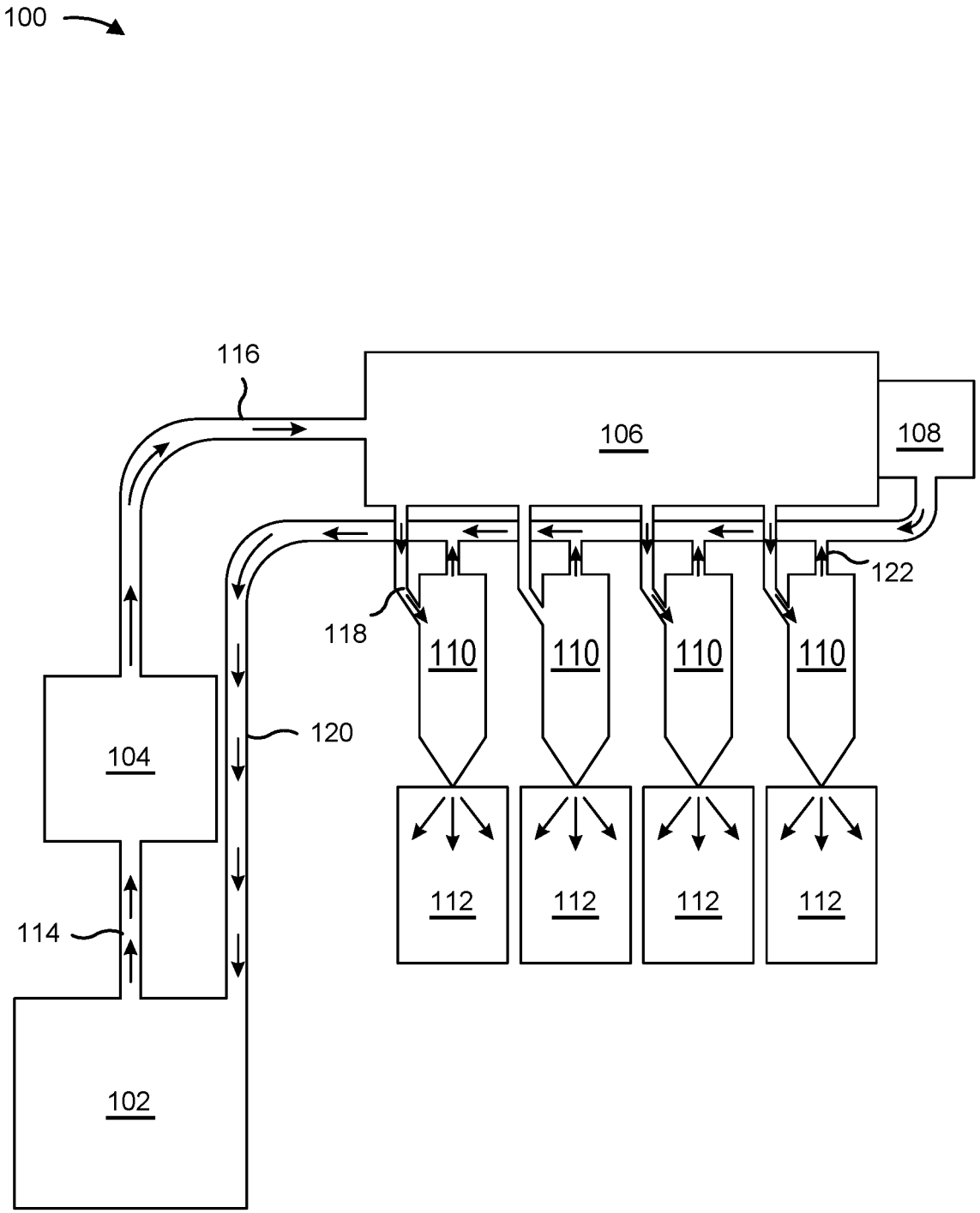
FIG. 1 is a diagram of an example fuel system, according to one or more aspects of the present disclosure.

FIG. 1 is a diagram of an example fuel system 100. The fuel system 100 is configured to control delivery of fuel to allow chemical energy stored in the fuel to be converted into mechanical work (e.g., to propel a vehicle). The fuel system 100 includes a fuel tank 102, a pump 104, a common rail 106, a pressure limiter 108, and a plurality of fuel injectors 110 (e.g., 6 fuel injectors, 8 fuel injectors, 12 fuel injectors, and/or the like). The plurality of fuel injectors 110 are positioned to discharge the atomized fuel directly into combustion chambers within a plurality of cylinders 112 (e.g., 6 cylinders, 8 cylinders, 12 cylinders, and/or the like). The plurality of cylinders 112 may form part of a four-stroke engine, a two-stroke engine, and/or the like. In some implementations, the fuel system 100 may include an electronic control unit, one or more sensors, one or more additional pumps, and/or the like.

The fuel tank 102 is a storage tank configured to store fuel. The fuel may be introduced into the fuel tank 102 via a sealable opening and may be configured to travel, via a first fuel delivery line 114, from the fuel tank 102 to the pump 104. The fuel is a fluid that is configured to combust within the plurality of cylinders 112 to drive a drivetrain. For example, the fuel may be a diesel fuel, such as petroleum diesel fuel, a synthetic diesel fuel, a biodiesel fuel, and/or the like.

The pump 104 is a mechanism that is configured to pressurize the fuel at a pressure that allows proper combustion. For example, the pressure may be in a range of approximately 5,000 psi to approximately 40,000 psi. After the pump 104 pressurizes the fuel, the pump 104 is configured to deliver the pressurized fuel along a second fuel delivery line 116 to the common rail 106. The common rail 106, in turn, is a conduit that is configured to distribute the pressurized fuel along a plurality of third fuel delivery lines 118 to the plurality of fuel injectors 110. The common rail 106 may be further configured to expel an excess amount of the fuel into the pressure limiter 108, which is a mechanism that is configured to route the excess fuel, via a first fuel return line 120, back to the fuel tank 102.

The plurality of fuel injectors 110 are mechanisms that are configured to introduce the pressurized fuel into the plurality of cylinders 112. The plurality of fuel injectors 110 are further configured to expel bypass fuel along a plurality of second fuel return lines 122 into the first fuel return line 120 to travel back to the fuel tank 102. The plurality of cylinders 112 are engine components. Each includes a respective piston movably mounted therein to travel in a 4-stroke cycle to cause the fuel to combust, which drives the drivetrain. The plurality of cylinders 112 may be arranged in an in-line configuration, a "V" configuration, or another suitable configuration.

As indicated above, FIG. 1 is provided as an example. Other examples may differ from what is described with regard to FIG. 1. The number and arrangement of devices shown in FIG. 1 are provided as an example. In practice, there may be additional devices, fewer devices, different devices, and/or differently arranged devices than those shown in FIG. 1. Furthermore, two or more devices shown in FIG. 1 may be implemented within a single device, or a single device shown in FIG. 1 may be implemented as multiple, distributed devices. While the fuel system 100 is shown and described as a common rail system involving diesel fuel, it should be understood that other types of fuel systems and fuels (e.g., gasoline fuel, compressed natural gas fuel, or other types of fuel) are contemplated.

Figure 2:
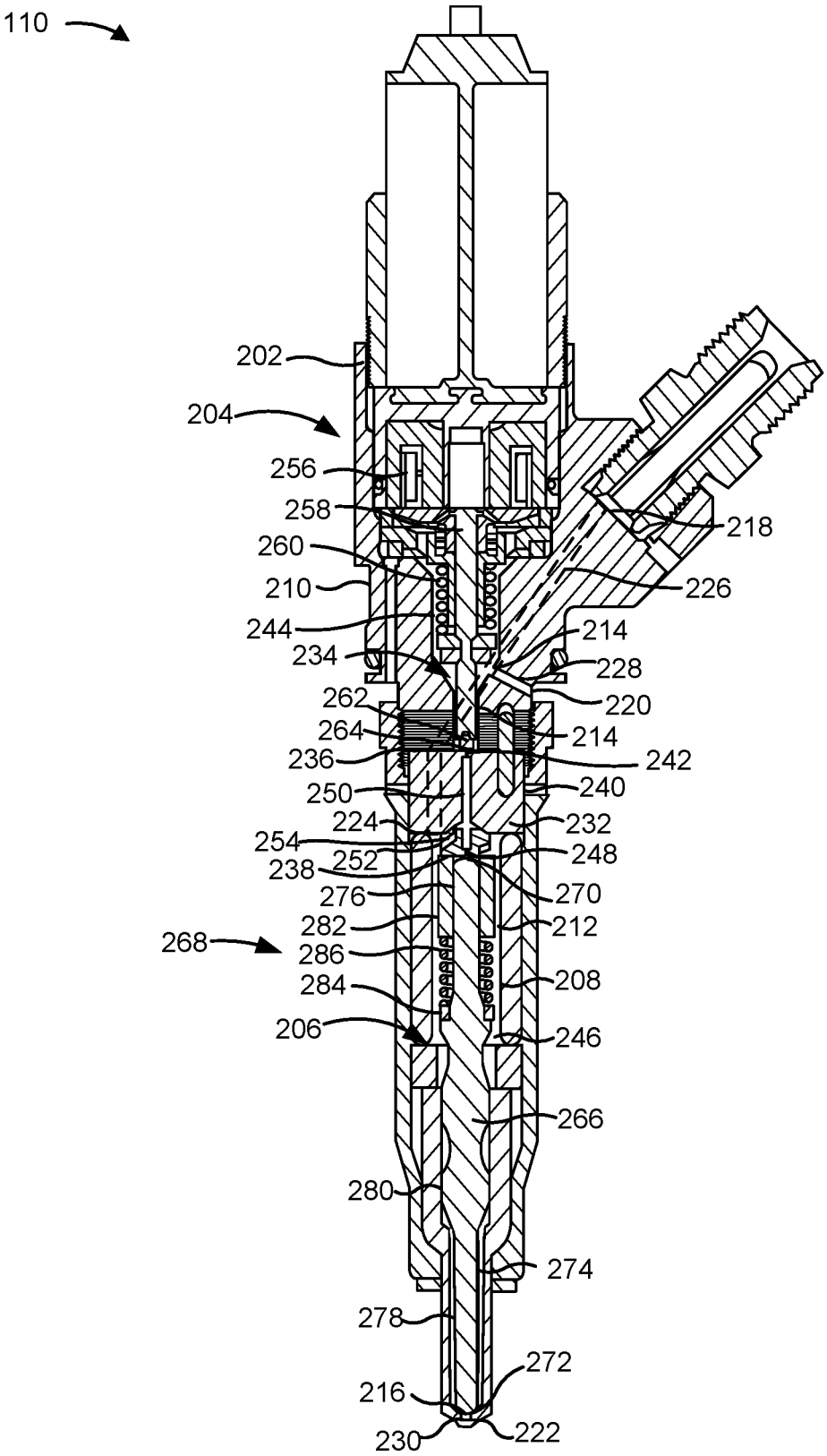
FIG. 2 is a cross-sectional view of an example fuel injector of the fuel system, according to one or more aspects of the present disclosure.

FIG. 2 is a diagram of a fuel injector 110 of the plurality of fuel injectors 110. As shown in FIG. 2, the fuel injector 110 includes a fuel injector body 202, an actuation assembly 204, and a needle valve assembly 206. The fuel injector body 202, which houses the actuation assembly 204 and the needle valve assembly 206, includes an interior surface 208 and an exterior surface 210. The interior surface 208 defines an interior space 212 of the fuel injector body 202 and includes an interior drain opening 214 and an interior outlet opening 216. The exterior surface 210 is opposite the interior surface 208 and includes an exterior inlet opening 218, an exterior drain opening 220, and an exterior outlet opening 222. The exterior inlet opening 218 fluidly communicates with an interior inlet opening 224 (which is formed in the sealing member 232, as described below) to define an inlet 226 (shown in dotted lines) that allows fuel to travel from one of the plurality of third fuel delivery lines 118 into the fuel injector 110. The exterior drain opening 220 fluidly communicates with the interior drain opening 214 to define a drain 228 that allows fuel to travel from the fuel injector 110 into one of the plurality of second fuel return lines 122. The exterior outlet opening 222 fluidly communicates with the interior outlet opening 216 to define an outlet 230 that allows the fuel to travel from the fuel injector 110 into one of the plurality of cylinders 112.

The actuation assembly 204 includes a sealing member 232 and a control valve assembly 234. The sealing member 232, which may be a single, integrally-formed component or a combination of multiple components, includes an upper surface 236, a lower surface 238 that is opposite the upper surface 236, and an outer surface 240 connecting the upper surface 236 to the lower surface 238. The upper surface 236 includes an upper opening 242 and defines a junction between an upper chamber 244 of the interior space 212 and a lower chamber 246 of the interior space 212. The lower surface 238 includes the interior inlet opening 224 and a lower opening 248, which fluidly communicates with the upper opening 242 to define a longitudinal channel 250. The outer surface 240 includes one or more outer openings 252 that fluidly communicate, respectively, with one or more re-pressurization orifices 254. The one or more re-pressurization orifices 254, which may be angled relative to the longitudinal channel 250, may intersect with the longitudinal channel 250 and/or the lower surface 238 of the sealing member 232.

The control valve assembly 234, which is provided in the upper chamber 244, includes a solenoid actuator 256, a plunger 258, a first spring 260, and a control valve 262. The solenoid actuator 256 is a device that is configured to convert electrical energy into mechanical work (e.g., by causing the plunger 258 to lift out of a clamping position (shown in FIG. 2)). For example, the solenoid actuator may include an electromagnetic coil. The plunger 258, which may form or be attached to an armature, is an elongated structure that is configured to clamp the control valve 262 against the upper surface 236 of the sealing member 232 when the plunger 258 is in the clamping position. The first spring 260 is configured to bias the plunger 258 into the clamping position against the control valve 262. For example, the first spring 260 may be a helical spring or another type of biasing member that applies a biasing force onto the plunger 258. The control valve 262 is configured to seal the upper opening 242 of the upper surface 236 of the sealing member. To form the seal, the control valve 262 includes a flat surface 264 that is configured to cover the upper opening 242 while abutting the upper surface 236.

The needle valve assembly 206, which is provided in the lower chamber 246, includes a needle valve 266 and a spring assembly 268. The needle valve 266 is an elongated structure that is configured to slide within the fuel injector body 202 between a closed position (shown in FIG. 2) and an open position (not shown). As will be described in further detail below, the needle valve 266 includes a top end surface 270, a bottom end surface 272, and an exterior surface 274 connecting the top end surface 270 to the bottom end surface 272. The top end surface 270 is configured to face and/or contact the lower surface 238 of the sealing member 232. The bottom end surface 272 is configured to face and/or contact the interior outlet opening 216 of the fuel injector body 202. The exterior surface 274, which includes a spring-retaining section 276, a tip section 278, and a guide section 280 therebetween, is configured to face and/or contact the interior surface 208 of the fuel injector body 202.

The spring assembly 268 includes a sleeve 282, a spacer 284, and a second spring 286 arranged therebetween. The sleeve 282 and the spacer 284 are annular devices that are configured to secure the second spring 286 to the spring-retaining section 276 of the needle valve 266. The second spring 286 is configured to bias the needle valve 266 into the fuel sealing position, in which the bottom end surface 272 of the needle valve 266 covers the interior outlet opening 216 of the fuel injector body 202. For example, the second spring 286 may be a helical spring or another type of biasing member that applies a biasing force onto the needle valve 266.

In use, fuel may enter the fuel injector 110 via the inlet 226 and thereafter accumulate in the lower chamber 246 of the interior space 212. Because the first spring 260 applies the biasing force against the plunger 258, the plunger 258 presses downward against the control valve 262, thereby preventing the fuel from entering the upper chamber 244 via the longitudinal channel 250. The needle valve 266, due to a combined downward force provided by the fuel and the second spring 286, is pressed downward against the interior outlet opening 216, thereby preventing the fuel from traveling therethrough. As a result, when the plunger 258 is in the clamping position and the needle valve 266 is correspondingly in the closed position, the fuel is trapped in the lower chamber 246 of the fuel injector 110 and highly pressurized.

When the solenoid actuator 256 is energized, however, a magnetic field of the solenoid actuator 256 overcomes the biasing force of the first spring 260, causing the plunger 258 to move toward the solenoid actuator 256 and away from the control valve 262. With the plunger 258 no longer applying a clamping force on the control valve 262, the control valve 262 is pushed upward by a force of the fuel flowing through the longitudinal channel 250. This flow of the fuel from the lower chamber 246 to the upper chamber 244 creates a pressure differential. The pressure differential results in a significant hydraulic force that acts on the needle valve 266 and causes the needle valve 266 to move toward the sealing member 232 and away from the interior outlet opening 216 into the open position. Because of this movement, the fuel flows downwardly along the needle valve 266 and into the one of the plurality of cylinders 112 via the outlet 230 (a process which may be referred to elsewhere herein as an injection event).

As indicated above, FIG. 2 is provided as an example. Other examples may differ from what is described with regard to FIG. 2. The number and arrangement of shown in FIG. 2 devices (e.g., the sealing member 232, the solenoid actuator 256, the first spring 260, the control valve 262, the needle valve 266, the sleeve 282, the spacer 284, and/or the second spring 286) are provided as an example. In practice, there may be additional devices, fewer devices, different devices, and/or differently arranged devices than those shown in FIG. 2. Furthermore, two or more devices shown in FIG. 2 may be implemented within a single device, or a single device shown in FIG. 2 may be implemented as multiple, distributed devices.

Figure 3:
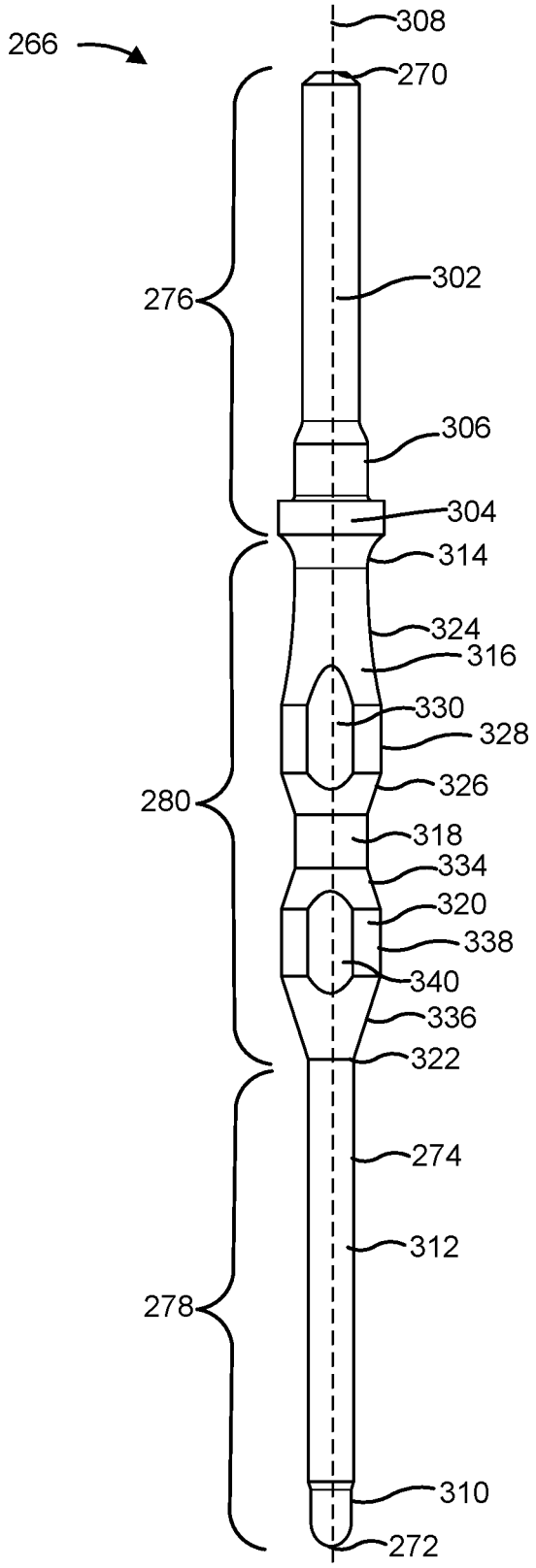
FIG. 3 is side view of an example needle valve of the fuel injector, according to one or more aspects of the present disclosure.
Figure 4:
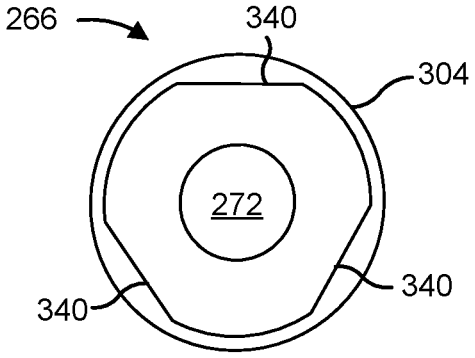
FIG. 4 is a bottom view of the needle valve of the fuel injector, according to one or more aspects of the present disclosure.

FIGS. 3-4 are diagrams of the needle valve 266. As indicated above, the exterior surface 274 of the needle valve 266 includes the spring-retaining section 276, the tip section 278, and the guide section 280 therebetween. The spring-retaining section 276, which is configured to support the spring assembly 268, includes a first elongated portion 302, a flange 304, and a stepped portion 306. The first elongated portion 302 is adjacent to the top end surface 270 of the needle valve 266 and is configured to receive the sleeve 282 and a main portion of the second spring 286. The flange 304 is adjacent to the guide section 280 and is configured to support the spacer 284. The stepped portion 306 is arranged between the first elongated portion 302 and the flange 304 and is configured to receive the spacer 284 and a bottom end portion of the second spring 286.

To support the spring assembly 268 as described above, a diameter of the first elongated portion 302 may be less than a diameter of the stepped portion 306, and the diameter of the stepped portion 306 may be less than a diameter of the flange 304. For example, the diameter of the first elongated portion 302 may be in a range of approximately 3.5 millimeters (mm) to approximately 4.5 mm. The diameter of the stepped portion 306 may be in a range of approximately 5 mm to approximately 6 mm. The diameter of the flange 304 may be in a range of approximately 7 mm to approximately 8 mm. Furthermore, a length of the first elongated portion 302, along a longitudinal axis 308 of the needle valve 266, may be greater than a length of the stepped portion 306, and the length of the stepped portion 306 may be greater than a length of the flange 304. For example, the length of the first elongated portion 302 may be in a range of approximately 20 mm to approximately 22 mm. The length of the stepped portion 306 may be in a range of approximately 3 mm to approximately 4 mm. The length of the flange 304 may be in a range of approximately 1.5 mm to approximately 2.5 mm. In some implementations, an overall length of the spring-retaining section 276 may be in a range of approximately 25 mm to approximately 30 mm.

The tip section 278 is configured to facilitate flow of the fuel therealong and through the outlet 230 when the needle valve 266 is in the open position and to seal the outlet 230 when the needle valve 266 is in the closed position. The tip section 278 includes an end portion 310 and a second elongated portion 312. The end portion 310 is adjacent to the bottom end surface 272 of the needle valve 266, and the second elongated portion 312 is adjacent to the guide section 280 of the needle valve 266. A diameter of the end portion 310 may be less than a diameter of the second elongated portion 312. For example, the diameter of the end portion 310 may be in a range of approximately 2 mm to approximately 3 mm. The diameter of the second elongated portion 312 may be in a range of approximately 3.5 mm to approximately 4.5 mm. Furthermore, a length of the end portion 310 may be less than a length of the second elongated portion 312. For example, the length of the end portion 310 may be in a range of approximately 3.5 mm to approximately 4.5 mm. The length of the second elongated portion 312 may be in a range of approximately 24 mm to approximately 26 mm. An overall length of the tip section 278 may be substantially equal (e.g., within a threshold difference) to the overall length of the spring-retaining section 276. For example, in some implementations, the overall length of the tip section maybe in a range of approximately 25 mm to approximately 30 mm.

The guide section 280, which connects the spring-retaining section 276 to the tip section 278, is configured to mitigate pressure waves in the fuel while guiding the fuel therealong. The guide section 280 includes a first constricted portion 314, a first expanded portion 316, a second constricted portion 318, a second expanded portion 320, and a third constricted portion 322, which together define an undulating shape of the guide section 280. In other words, the guide section 280 includes a plurality of first constricted portions (e.g., the first constricted portion 314, the second constricted portion 318, and the third constricted portion 322) alternatingly arranged with a plurality of expanded portions (e.g., the first expanded portion 316 and the second expanded portion 320).

The first constricted portion 314 is adjacent to the flange 304 of the spring-retaining section 276. The first expanded portion 316 connects the first constricted portion 314 to the second constricted portion 318. To form an expanded shape while permitting the fuel to flow therealong, the first expanded portion 316 includes a first upper sloping portion 324, a first lower sloping portion 326, a first linear portion 328, and a plurality of first indentations 330 (e.g., three first indentations). To facilitate manufacturing, the first upper sloping portion 324 and the first lower sloping portion 326 may form acute angles relative to the longitudinal axis 308 of the needle valve 266 (e.g., in respective ranges of approximately 10 degrees to approximately 15 degrees, and approximately 20 degrees to approximately 25 degrees). The first linear portion 328 is substantially parallel to the longitudinal axis 308. The plurality of first indentations 330, which may be substantially planar and circumferentially spaced apart about the first expanded portion 316, extend along the first linear portion 328 and at least a portion of each of the first upper sloping portion 324 and the first lower sloping portion 326. Together with the interior surface 208, the plurality of first indentations 330 form a plurality of first fuel passages to permit the fuel to flow downwardly therealong.

The second constricted portion 318, which is configured to temporarily reduce pressure in the fuel to mitigate pressure waves, connects the first expanded portion 316 to the second expanded portion 320. The second expanded portion 320, in turn, connects the second constricted portion 318 to the third constricted portion 322. To form an expanded shape while permitting the fuel to flow therealong, the second expanded portion 320 includes a second upper sloping portion 334, a second lower sloping portion 336, a second linear portion 338, and a plurality of second indentations 340. The second upper sloping portion 334 and the second lower sloping portion 336 form acute angles relative to the longitudinal axis 308 of the needle valve 266 (e.g., in a range of approximately 20 degrees to approximately 25 degrees). The second linear portion 338 is substantially parallel to the longitudinal axis 308. The plurality of second indentations 340, which may be substantially planar and circumferentially spaced apart about the second expanded portion 320, extend along the second linear portion 338 and at least a portion of each of the second upper sloping portion 334 and the second lower sloping portion 336. Together with the interior surface 208, the plurality of second indentations 340 form a plurality of second fuel passages to permit the fuel to flow downwardly therealong. The third constricted portion 322 connects the second expanded portion 320 to the second elongated portion 312 of the tip section 278.

Respective diameters of the plurality of constricted portions may be substantially equal to one another. Respective diameters of the linear portions of the plurality of expanded portions, which are greater than the respective diameters of the plurality of constricted portions, may likewise be substantially equal to one another. For example, a diameter of one of the plurality of constricted portions may be in a range of approximately 4.5 mm to approximately 5.5 mm. To contact the interior surface 208 and thus facilitate sliding movement of the needle valve 266, a diameter of one of the linear portions (e.g., the first linear portion 328 and/or the second linear portion 338) may be substantially equal to a diameter of the interior surface 208. For example, the diameter of one of the linear portions may be in a range of approximately 7 mm to approximately 8 mm. In some implementations, a ratio of the diameter of one of the plurality of constricted portions to the diameter of one of the linear portions may be in a range of approximately 0.50 to approximately 0.75. Respective depths of the indentations (e.g., the plurality of first indentations 330 and/or the plurality of second indentations 340) may be substantially equal to one another. For example, the respective depths of the indentations may be in a range of approximately 0.25 mm to approximately 0.75 mm. Additionally, a length of the first linear portion 328 may be substantially equal to a length of the second linear portion 338. For example, the length of the first linear portion 328 and the length of the second linear portion 338 may be in a range of approximately 3 mm to approximately 6 mm. Furthermore, a distance between a first junction of the first upper sloping portion 324 and the first linear portion 328 and a second junction of the second lower sloping portion 336 and the second linear portion 338, which may be referred to herein as an effective guide length, may be in a range of approximately 8 mm to approximately 16 mm. In order to mitigate issues associated with alignment within the fuel injector 110, an overall length of the guide section 280 may be substantially equal to the overall lengths of the spring-retaining section 276 and the tip section 278. For example, in some implementations, the overall length of the guide section 280 may be in a range of approximately 25 mm to approximately 30 mm.

As configured, when the needle valve 266 is in the open position, the needle valve 266 may guide the fuel sequentially along the spring-retaining section 276 and the first constricted portion 314, through the plurality of first fuel passages, along the second constricted portion 318, through the plurality of second fuel passages, along the third constricted portion 322 and the tip section 278, and through the outlet 230 of the fuel injector 110. To withstand forces associated with repeated injection events, the needle valve 266 may be formed of a single, integral piece of hardened material, such as hardened steel. An overall length of the needle valve 266 may be in a range of approximately 50 mm to approximately 90 mm.

As indicated above, FIGS. 3-4 are provided as an example. Other examples may differ from what is described with regard to FIGS. 3-4. The number and arrangement of components shown in FIGS. 3-4 (e.g., the first elongated portion 302, the stepped portion 306, the flange 304, the plurality of constricted portions, the plurality of expanded portions, the indentations, the second elongated portion 312, and/or the end portion 310) are provided as an example. In practice, there may be additional components, fewer components, different components, differently sized components, differently shaped components, and/or differently arranged components than those shown in FIGS. 3-4. For example, the first expanded portion 316 and/or the second expanded portion 320 may include a different quantity of indentations than three (e.g., one indentation, two indentations, four indentations). As another example, the indentations may each have a variable depth (e.g., due to the indentations including a sloping surface, a curved surface, or another type of non-planar surface).

Figure 5:
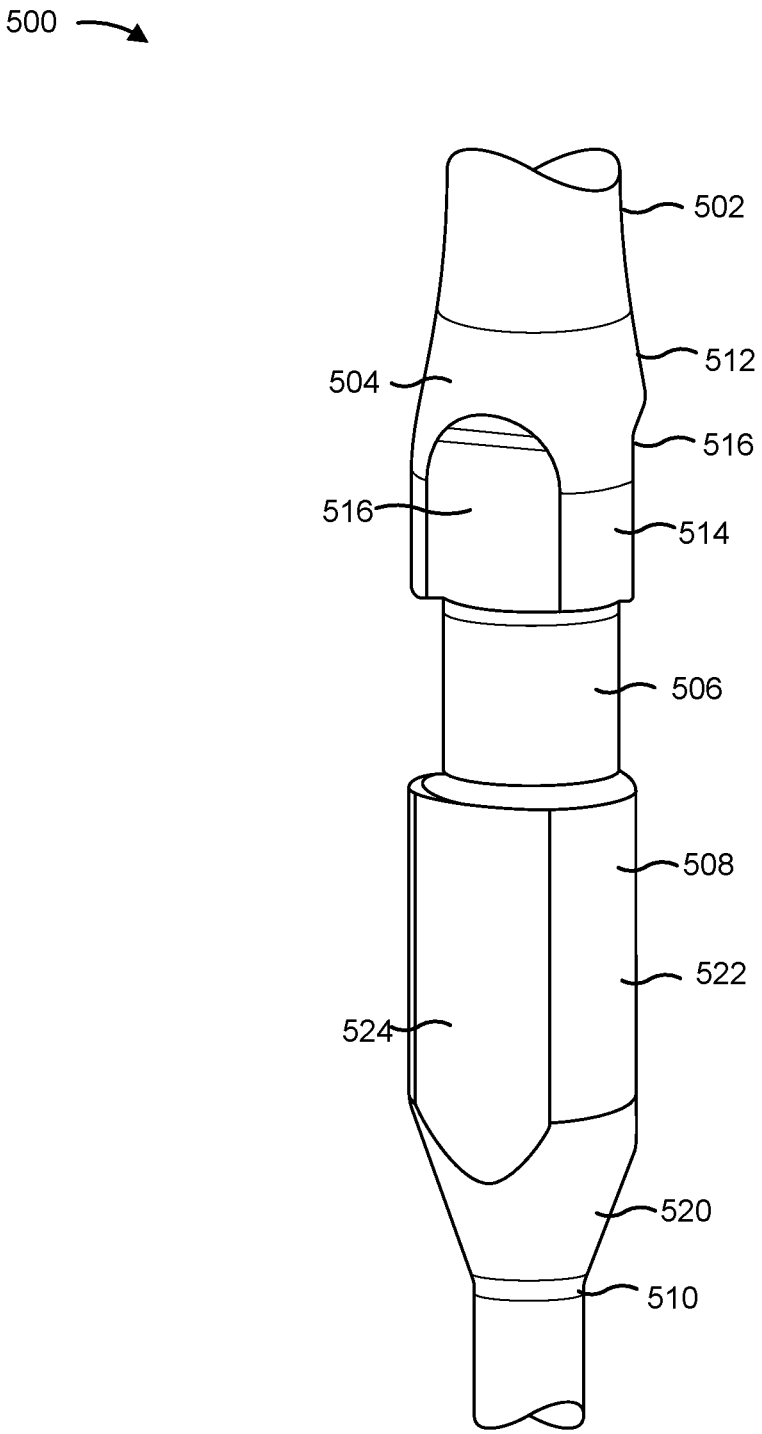
FIG. 5 is a side view of an example guide section of a needle valve, according to one or more aspects of the present disclosure.

FIG. 5 is a guide section 500, which constitutes example variation of the guide section 280. It should be understood that the guide section 500 may have substantially the same functionality and overall length as that of the guide section 280.

As shown in FIG. 5, the guide section 500 includes, in the same sequential arrangement as described above with respect to the guide section 280, a first constricted portion 502, a first expanded portion 504, a second constricted portion 506, a second expanded portion 508, and a third constricted portion 510. To form an expanded shape while permitting the fuel to flow therealong, the first expanded portion 504 includes a first sloping portion 512, a first linear portion 514, and a plurality of first indentations 516 (e.g., three first indentations). To facilitate manufacturing, the first sloping portion 512 may form an acute angle relative to the longitudinal axis 308 of the needle valve 266 (e.g., in a range of approximately 10 degrees to approximately 15 degrees). The first linear portion 514 is substantially parallel to the longitudinal axis 308. The plurality of first indentations 516, which may be substantially planar and circumferentially spaced apart about the first expanded portion 504, extend along the first linear portion 514 and at least a portion of the first sloping portion 512. Together with the interior surface 208, the plurality of first indentations 516 form a plurality of first fuel passages to permit the fuel to flow downwardly therealong.

To form an expanded shape while permitting the fuel to flow therealong, the second expanded portion 508 includes a second sloping portion 520, a second linear portion 522, and a plurality of second indentations 524 (e.g., three second indentations). The second sloping portion 520 forms an acute angle relative to the longitudinal axis 308 of the needle valve 266 (e.g., in a range of approximately 20 degrees to approximately 25 degrees). The second linear portion 522 is substantially parallel to the longitudinal axis 308. The plurality of second indentations 524, which may be substantially planar and circumferentially spaced apart about the second expanded portion 508, extend along the second linear portion 522 and at least a portion of the second sloping portion 520. Together with the interior surface 208, the plurality of second indentations 524 form a plurality of second fuel passages to permit the fuel to flow downwardly therealong.

The diameters and ratios of the plurality of constricted portions (e.g., the first constricted portion 502, the second constricted portion 506, and the third constricted portion 510) and the plurality of expanded portions (e.g., the first expanded portion 504 and the second expanded portion 508) may be substantially the same as that described above with respect to the guide section 280. However, each of the plurality of first indentations 516 may have a depth that is greater than a depth of each of the plurality of second indentations 524. For example, the respective depths of the plurality of first indentations 516 may be in a range of approximately 0.25 mm to approximately 0.50 mm. The respective depths of the plurality of second indentations 524 may be in a range of approximately 0.50 mm to approximately 0.75 mm. Furthermore, a length of the first linear portion 514 may be less than a length of the second linear portion 522. For example, the length of the first linear portion 514 may be in a range of approximately 2 mm to approximately 4 mm, and the length of the second expanded portion 508 may be in a range of approximately 8 mm to approximately 12 mm.

As indicated above, FIG. 5 is provided as an example. Other examples may differ from what is described with regard to FIG. 5. The number and arrangement of components shown in FIG. 5 are provided as an example. In practice, there may be additional components, fewer components, different components, differently sized components, differently shaped components, and/or differently arranged components than those shown in FIG. 5. For example, while the above description indicates three first indentations and three second indentations, there be fewer indentations (e.g., one or two indentations) or additional indentations (e.g., four or five indentations) in the guide section 500.

INDUSTRIAL APPLICABILITY

The needle valve 266 is particularly applicable within a fuel injector, such as the fuel injector 110. The fuel injector 110 may be implemented within a machine, such as a motor vehicle, a railed vehicle, a watercraft, an aircraft, a generator, or another type of machine.

Due to the shape and/or arrangement of the guide section 280 and 500 of the needle valve 266, in relation to the spring-retaining section 276 and the tip section 278, the needle valve 266 is configured to mitigate pressure waves that may be generated during frequent injection events. In particular, the second constricted portion 318 and 506 causes the pressure in the fuel to temporality decrease, which stabilizes sliding motion of the needle valve 266. As a result, the needle valve 266 may improve engine performance and minimize a potential of component damage. Furthermore, because the guide section 280/500 is elongated to have substantially the same length as the tip section 278, the needle valve 266 has improved alignment and may experience fewer deflection issues when sliding between the open position and the closed position within the fuel injector body 202.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, as used herein, the terms "comprises," "comprising," "having," "including," or other variations thereof, are intended to cover non-exclusion, such that a process, method, article, or apparatus that comprises a list of elements does not include only those elements, but may include other elements not expressly listed. In addition, in this disclosure, relative terms, such as, for example, "about," "generally," "substantially," and "approximately" are used to indicate a possible variation of ±10% of the stated value, except where otherwise apparent to one of ordinary skill in the art from the context. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A fuel injector, comprising:

a fuel injector body including an outlet; and a needle valve slidably arranged within the fuel injector body, the needle valve including:

a top end surface that is configured to intermittently contact a sealing member;

a bottom end surface that is configured to contact the outlet of the fuel injector body when the top end surface is spaced a distance from the sealing member and the needle valve is in a closed position; and an exterior surface that connects the top end surface to the bottom end surface and includes:

a spring-retaining section that is adjacent to the top end surface and configured to support a spring that biases the needle valve toward the closed position, a tip section that is adjacent to the bottom end surface, and a guide section that connects the spring-retaining section to the tip section and includes:

a first expanded portion including at least one first indentation and having a first diameter, a second expanded portion including at least one second indentation and having a second diameter, and a constricted portion connecting the first expanded portion to the second expanded portion and having a constricted portion diameter that is less than each of the first diameter and the second diameter; and wherein a ratio of the constricted portion diameter to the first diameter is in a range of approximately 0.50 to approximately 0.75.

2. The fuel injector of claim 1, wherein a first angle of the first expanded portion and a second angle of the second expanded portion, relative to a longitudinal axis of the needle valve, are in a range of approximately 20 degrees to approximately 25 degrees.

3. The fuel injector of claim 1, wherein the first expanded portion includes a first linear portion that includes the at least one first indentation, the second expanded portion includes a second linear portion that includes the at least one second indentation, a first length of the first linear portion is substantially equal to a second length of the second linear portion, and a first depth of the at least one first indentation is substantially equal to a second depth of the at least one second indentation.

4. The fuel injector of claim 1, wherein the first expanded portion includes a first linear portion that includes the at least one first indentation, the second expanded portion includes a second linear portion that includes the at least one second indentation, a first length of the first linear portion is less than a second length of the second linear portion, and a first depth of the at least one first indentation is greater than a second depth of the at least one second indentation.

5. The fuel injector of claim 1, wherein the at least one first indentation includes at least three first indentations, and the at least one second indentation includes at least three second indentations.

6. The fuel injector of claim 1, wherein the spring-retaining section comprises a first elongated portion and a flange;

the tip section comprises a second elongated portion; and the guide section further comprises:

a second constricted portion that connects the flange and the first expanded portion; and a third constricted portion that connects the second expanded portion and the second elongated portion.

7. A fuel injector, comprising:

a fuel injector body including an outlet; and a needle valve slidably arranged in the fuel injector body, the needle valve including:

a spring-retaining section including an elongated portion and a flange that are together configured to support a spring assembly, wherein the spring-retaining section has a first length;

a tip section adjacent the outlet of the fuel injector; and a guide section adjacent to the spring-retaining section and between the spring-retaining section and the tip section, the guide section including a plurality of constricted portions alternatingly arranged with a plurality of expanded portions to define an undulating shape of the guide section, wherein each of the plurality of expanded portions includes a plurality of indentations to permit fuel to travel therealong to exit the outlet of the fuel injector body, and the guide section has a second length that is substantially equal to the first length.

8. The fuel injector of claim 7, wherein the first length and the second length are each in a range of approximately 25 millimeters to approximately 30 millimeters.

9. The fuel injector of claim 7, wherein the plurality of indentations includes four indentations.

10. The fuel injector of claim 7, wherein the plurality of indentations are substantially planar.

11. The fuel injector of claim 7, wherein each expanded portion of the plurality of expanded portions includes:

a sloping portion that forms an acute angle relative to a longitudinal axis of the needle valve, and a linear portion that is substantially parallel to the longitudinal axis of the needle valve.

12. The fuel injector of claim 7, wherein the tip section has a third length that is substantially equal to the second length.

13. The fuel injector of claim 7, wherein the needle valve is made of a single, integral piece of hardened steel.

14. A fuel injector comprising:

a fuel injector body including an interior surface that includes an opening; and a needle valve slidably arranged within the fuel injector body, the needle valve including:

a tip section that is configured to seal the opening when the needle valve is in a closed position, a spring-retaining section that is configured to support a spring assembly that biases the needle valve into the closed position, and a guide section extending between the tip section and the spring-retaining section and including at least one indentation that together with the interior surface of the fuel injector body defines at least one fuel passage, wherein a diameter of the guide section is substantially equal to a diameter of the interior surface, and a length of the guide section is substantially equal to each of a length of the spring-retaining section and a length of the tip section.

15. The fuel injector of claim 14, wherein the guide section includes a plurality of constricted portions alternatingly arranged with a plurality of expanded portions to define an undulating shape of the guide section, wherein each of the plurality of expanded portions includes the at least one indentation.

16. The fuel injector of claim 15, wherein the diameter of the guide section is a diameter of one of the plurality of expanded portions.

17. The fuel injector of claim 15, wherein the at least one indentation includes at least two indentations.

18. The fuel injector of claim 14, wherein the at least one indentation includes a sloping surface that defines a variable depth of the at least one fuel passage.

19. The fuel injector of claim 14, wherein the needle valve has a length in a range of approximately 80 millimeters to approximately 90 millimeters, and the diameter is in a range of approximately 7 millimeters to approximately 8 millimeters.

* * * * *